US009075347B2

(12) United States Patent
Uchida et al.

(10) Patent No.: US 9,075,347 B2
(45) Date of Patent: Jul. 7, 2015

(54) DEVELOPING DEVICE AND IMAGE FORMING APPARATUS

(71) Applicant: FUJI XEROX CO., LTD., Tokyo (JP)

(72) Inventors: Masahiro Uchida, Kanagawa (JP); Manabu Furuki, Kanagawa (JP); Masashi Ikeda, Kanagawa (JP); Tatsuhiro Igarashi, Kanagawa (JP); Teppei Yawada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/253,369

(22) Filed: Apr. 15, 2014

(65) Prior Publication Data

US 2015/0098734 A1 Apr. 9, 2015

(30) Foreign Application Priority Data

Oct. 7, 2013 (JP) ..... 2013-210048

(51) Int. Cl.
*G03G 15/09* (2006.01)
*G03G 15/095* (2006.01)
*G03G 15/08* (2006.01)

(52) U.S. Cl.
CPC ..... *G03G 15/095* (2013.01); *G03G 15/0928* (2013.01); *G03G 2215/0634* (2013.01); *G03G 15/0812* (2013.01); *G03G 2215/0866* (2013.01); *G03G 15/0914* (2013.01); *G03G 15/0808* (2013.01); *G03G 15/081* (2013.01)

(58) Field of Classification Search
CPC ..... G03G 15/09
USPC ..... 399/274
See application file for complete search history.

(56) References Cited

U.S. PATENT DOCUMENTS

| | | | | |
|---|---|---|---|---|
| 5,012,285 | A * | 4/1991 | Oka et al. | 399/260 |
| 7,463,854 | B2 * | 12/2008 | Nishida et al. | 399/284 |
| 7,894,755 | B2 * | 2/2011 | Lee | 399/284 |
| 2002/0044797 | A1 * | 4/2002 | Itoh | 399/269 |
| 2004/0265015 | A1 * | 12/2004 | Koike et al. | 399/274 |
| 2007/0253720 | A1 * | 11/2007 | Kasai | 399/27 |
| 2008/0131173 | A1 * | 6/2008 | Lee | 399/284 |
| 2008/0298848 | A1 * | 12/2008 | Lee | 399/274 |
| 2013/0202330 | A1 * | 8/2013 | Ochi et al. | 399/269 |

FOREIGN PATENT DOCUMENTS

| | | | | |
|---|---|---|---|---|
| JP | 2009-145409 | * | 7/2009 | G03G 15/08 |
| JP | A-2009-145409 | | 7/2009 | |
| JP | 2011-069856 | * | 4/2011 | G03G 15/08 |
| JP | A-2011-069856 | | 4/2011 | |
| JP | 2013-033171 | * | 2/2013 | G03G 15/08 |
| JP | A-2013-033171 | | 2/2013 | |

* cited by examiner

*Primary Examiner* — Clayton E Laballe
*Assistant Examiner* — Kevin Butler
(74) *Attorney, Agent, or Firm* — Oliff PLC

(57) ABSTRACT

Provided is a developing device including an accommodating unit that contains a developer, a transport member that holds the developer on an outer surface and transports the developer outside from the accommodating unit, a layer regulating member that faces the outer surface of the transport member with a gap, extends in a direction intersecting a direction in which the developer is transported, and regulates a layer thickness of the developer, and a removal member that is inserted into the gap, moves along the direction in which the layer regulating member extends, and removes the developer from the gap.

16 Claims, 6 Drawing Sheets

| | | TONER PARTICLE DIAMETER (D50vol.: VOLUME AVERAGE PARTICLE DIAMETER) | | |
|---|---|---|---|---|
| USE ENVIRONMENT | TRIMMER GAP | 3.5 μm | 4.5 μm | 5.5 μm |
| 22°C | 0.4 mm OR MORE | △ | ○ | ○ |
| | LESS THAN 0.4 mm | △ | ○ | ○ |
| 28°C | 0.4 mm OR MORE | △ | △ | ○ |
| | LESS THAN 0.4 mm | X | △ | ○ |

DEVELOPING DEVICE AND IMAGE FORMING APPARATUS

CROSS-REFERENCE TO RELATED APPLICATIONS

This application is based on and claims priority under 35 USC 119 from Japanese Patent Application No, 2013-210048 filed Oct. 7, 2013.

BACKGROUND (i) Technical Field

The present invention relates to a developing device and an image forming apparatus.

(ii) Related Art

In the related art, a developing device that develops a latent image on an image holding member and an image forming apparatus that forms an image developed by the developing device are known.

SUMMARY

According to an aspect of the invention, there is provided a developing device including:

an accommodating unit that contains a developer;

a transport member that holds the developer on an outer surface and transports the developer outside from the accommodating unit;

a layer regulating member that faces the outer surface of the transport member with a gap, extends in a direction intersecting a direction in which the developer is transported, and regulates a layer thickness of the developer; and a removal member that is inserted into the gap, moves along the direction in which the layer regulating member extends, and removes the developer from the gap.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the invention will be described with reference to the accompanying drawings.

Figure 1:
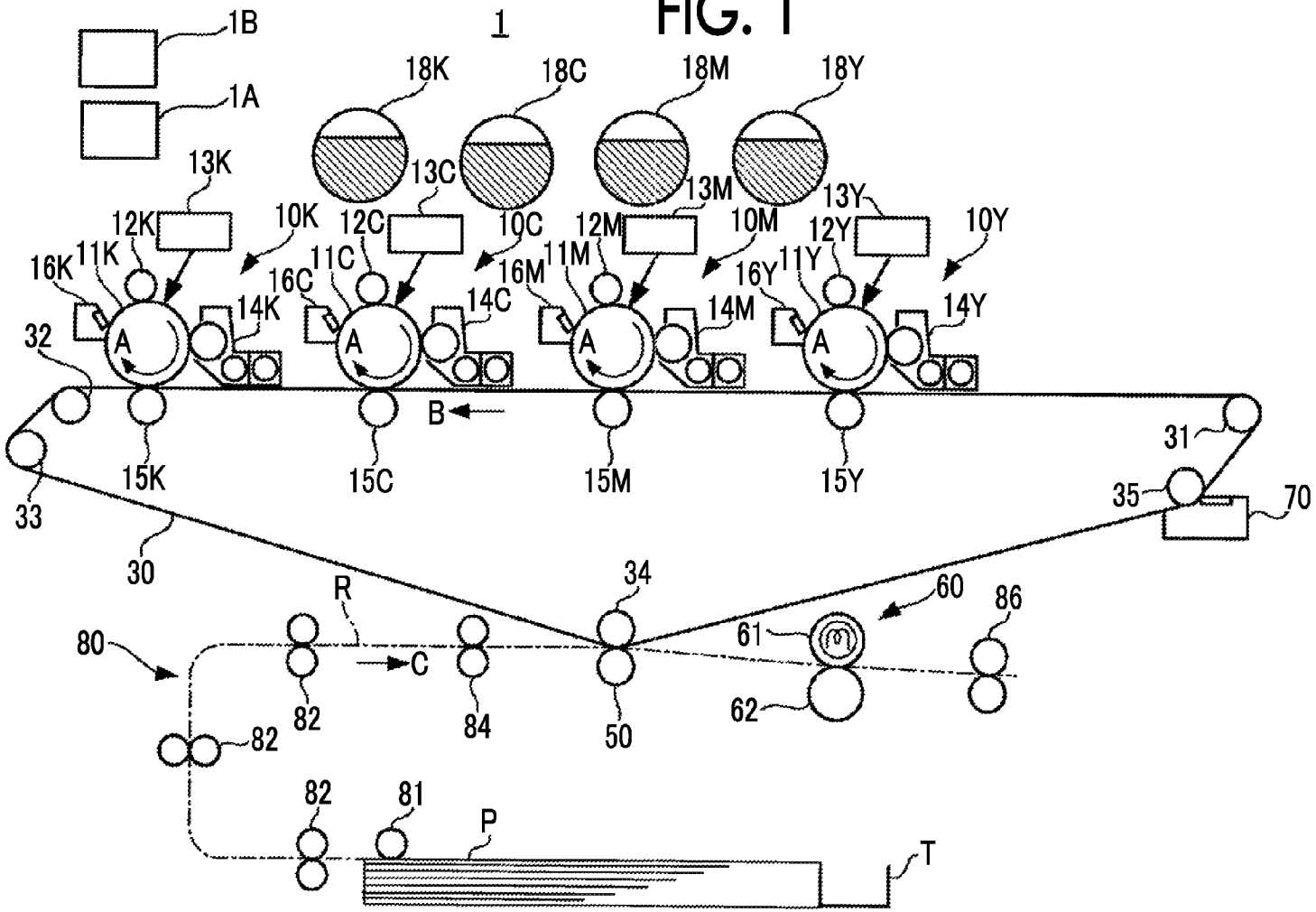
FIG. 1 is a configuration diagram illustrating an image forming apparatus according to an exemplary embodiment of the invention.

FIG. 1 is a configuration diagram illustrating an image forming apparatus according to an exemplary embodiment of the invention.

An image forming apparatus 1 that is illustrated in FIG. 1 is a tandem type color printer in which image forming units 10Y, 10M, 10C, and 10K are respectively arranged in parallel for yellow (Y), magenta (M), cyan (C), and black (K). The image forming apparatus 1 may print single-color images, and may print full-color images from toner images having four colors.

The image forming apparatus 1 includes toner cartridges 18Y, 18M, 18C, and 18K that accommodate the toner of the respective colors of YMCK.

The four image forming units 10Y, 10M, 10C, and 10K have the same configuration, except for developers that are used, and the image forming unit 10Y that corresponds to the yellow color will be described representatively. The image forming unit 10Y includes a photoconductor 11Y, a charging unit 12Y, an exposure unit 13Y, a developing device 14Y, a primary image transfer unit 15Y, and a photoconductor cleaner 16Y. Excluding the exposure unit 13Y and the primary image transfer unit 15Y, these elements constitute so-called process cartridges, and the process cartridges have a common structure.

The photoconductor 11Y has a photoconductor layer on a cylindrical substrate, holds an image which is formed on an outer surface, and rotates in an arrow A direction, that is, about an axis of the cylinder. The charging unit 12Y, the exposure unit 13Y, the developing device 14Y, the primary image transfer unit 15Y, and the photoconductor cleaner 16Y are sequentially arranged in a vicinity of the photoconductor 11Y. The photoconductor 11Y corresponds to an example of an image holding member of the exemplary embodiment of the invention. The charging unit 12Y and the exposure unit 13Y, combined with each other, correspond to an example of a latent image forming unit of the exemplary embodiments of the invention. The developing device 14Y corresponds to a developing device according to a first exemplary embodiment of the invention.

The charging unit 12Y charges the outer surface of the photoconductor 11Y. The charging unit 12Y according to this exemplary embodiment is a charging roller that is in contact with the outer surface of the photoconductor 11Y. A voltage having the same polarity as a charge polarity of the toner in the developing device 14Y is applied to the charging roller so that the outer surface of the photoconductor 11Y that contacts with the charging roller is charged. Instead of the charging roller, a corona discharger or the like that is not in contact with the photoconductor 11Y may also be adopted as the charging unit 12Y.

The exposure unit 13Y includes a light emitting device that emits a laser beam based on an image signal which is supplied from outside the image forming apparatus 1, and a rotating polygon mirror that scans the photoconductor 11Y with the laser beam, and the outer surface of the photoconductor 11Y is exposed when the photoconductor 11Y is irradiated with the laser beam. Instead of the laser beam type, for example, an LED array in which multiple LEDs are aligned along a scanning direction may also be used as the exposure unit 13Y. Further, instead of the exposure type, formation of a latent image directly with multiple electrodes aligned along the scanning direction or the like may also be used as the latent image forming unit.

The developing device 14Y develops the outer surface of the photoconductor 11Y by using a two-component developer formed of the toner and a magnetic carrier. The toner is supplied from the toner cartridge 18Y to the developing device 14Y, and the toner is mixed with the magnetic carrier in the developing device 14Y. Examples of the magnetic carrier include a resin-coated outer surface of ferrite powder. In addition, toner particles are formed by using, for example, a binder resin, a coloring agent, and a release agent. The developing device 14Y charges the toner and the magnetic carrier by agitating the developer in which magnetic carrier particles and the toner particles are mixed with each other, and develops the outer surface of the photoconductor 11Y with the charged toner.

The primary image transfer unit 15Y is a roller that faces the photoconductor 11Y across an intermediate image transfer belt 30. The primary image transfer unit 15Y includes a conductive elastic layer on an outer surface, and electrostatically suctions the toner image on the photoconductor 11Y to the intermediate image transfer belt 30 when a voltage having the polarity opposite to the charge polarity of the toner is applied. The photoconductor cleaner 16Y includes a cleaning blade that contacts with the outer surface of the photoconductor 11Y, and cleans the outer surface of the photoconductor 11Y after a transfer. More specifically, residual toner on the outer surface of the photoconductor 11Y is scraped off by the cleaning blade.

The image forming apparatus 1 further includes the intermediate image transfer belt 30, a fixing device 60, a sheet transport unit 80, and a control unit 1A that controls each of the units of the image forming apparatus 1. In addition, the image forming apparatus 1 further includes an environment sensor 1B that detects temperature and humidity environments in the image forming apparatus 1.

The intermediate image transfer belt 30 is an endless belt that is formed of a resin material which contains a conductive agent. The intermediate image transfer belt 30 is wrapped around belt support rollers 31 to 35, and moves in a circulating manner in an arrow B direction through the image forming units 10Y, 10M, 10C, and 10K, and a secondary image transfer unit 50. The toner images having the respective colors are transferred to the intermediate image transfer belt 30 from the image forming units 10Y, 10M, 10C, and 10K. The intermediate image transfer belt 30 moves with the toner images having the respective colors being held.

The secondary image transfer unit 50 is a roller that rotates with the intermediate image transfer belt 30 and a sheet being nipped between a backup roller 34, which is one of the belt support rollers 31 to 35, and the secondary image transfer unit 50. The secondary image transfer unit 50 includes a conductive elastic layer on an outer surface, and electrostatically suctions the toner image on the intermediate image transfer belt 30 to the sheet when the voltage having the polarity opposite to the charge polarity of the toner is applied.

A belt cleaner 70 has a blade which contacts with the intermediate image transfer belt 30 to scrape off the toner on the intermediate image transfer belt 30.

The fixing device 60 fixes the toner to the sheet. The fixing device 60 includes a heating roller 61 and a pressurizing roller 62, and a heater is built into the heating roller 61. The heating roller 61 and the pressurizing roller 62 fix the toner image onto the sheet by passing the sheet having a non-fixed toner image to a nip formed by the heating roller 61 and the pressurizing roller 62.

The sheet transport unit 80 includes a supply roller 81 that supplies the sheet which is accommodated in a sheet accommodator T, a transport roller 82 that transports the sheet, a registration roller 84 that transports the sheet to the secondary image transfer unit 50, and a discharge roller 86 that discharges the sheet outside. The sheet transport unit 80 transports the sheet along a sheet transport path R through the secondary image transfer unit. 50 and the fixing device 60.

As for a basic operation of the image forming apparatus 1 illustrated in FIG. 1, the photoconductor 11Y is driven to rotate in the arrow A direction in the image forming unit 10Y for the yellow color, and a charge is applied to the outer surface of the photoconductor 11Y by the charging unit 12Y. The exposure unit 13Y irradiates the outer surface of the photoconductor 11Y with exposure light based on the image signal corresponding to the yellow color, among the image signals supplied from outside, to form an electrostatic latent image on the outer surface of the photoconductor 11Y. The developing device 14Y forms the toner image by developing the electrostatic latent image with the toner. The yellow toner from the toner cartridge 18Y is supplied to the developing device 14Y at any time not limited to the same time as the developing. The photoconductor 11Y rotates with the yellow toner image formed on the outer surface being held. The toner image that is formed on the outer surface of the photoconductor 11Y is transferred to the intermediate image transfer belt 30 by the primary image transfer unit 15Y. The toner that remains on the photoconductor 11Y after the transfer is recovered and removed by the photoconductor cleaner 16Y.

The intermediate image transfer belt 30 is wrapped around the belt support rollers 31 to 35 and cyclically moves in the arrow B direction. The image forming units 10M, 10C, and 10K that correspond to the non-yellow colors respectively form the toner images for the respective colors corresponding to the respective image forming units in the same manner as the image forming unit 10Y for the yellow color, and the toner images having the respective colors are superposed on the toner image transferred by the image forming unit 10Y for the yellow color and are transferred to the intermediate image transfer belt 30.

A sheet P is taken out from the sheet accommodator T by the supply roller 81. The sheet P is transported on the sheet transport path R, in an arrow C direction directed toward the secondary image transfer unit 50, by the transport roller 82 and the registration roller 84. The registration roller 84 sends the sheet P to the secondary image transfer unit 50 so that the toner image on the intermediate image transfer belt 30 and the sheet P reach the secondary image transfer unit 50 at the same timing. The secondary image transfer unit 50 transfers the toner image on the intermediate image transfer belt 30 to the sheet P by applying a voltage for the transfer between the intermediate image transfer belt 30 and the sheet P. The sheet P to which the toner image is transferred is transported from the secondary image transfer unit 50 to the fixing device 60, and the toner image that is transferred onto the sheet is fixed. In this manner, the image is formed on the sheet. The sheet where the image is formed is discharged outside the image forming apparatus 1 by the discharge roller 86. The toner that remains on the intermediate image transfer belt 30 after the transfer by the secondary image transfer unit 50 is removed from the intermediate image transfer belt 30 by the belt cleaner 70.

Hereinafter, the developing device will be described.

Figure 2:
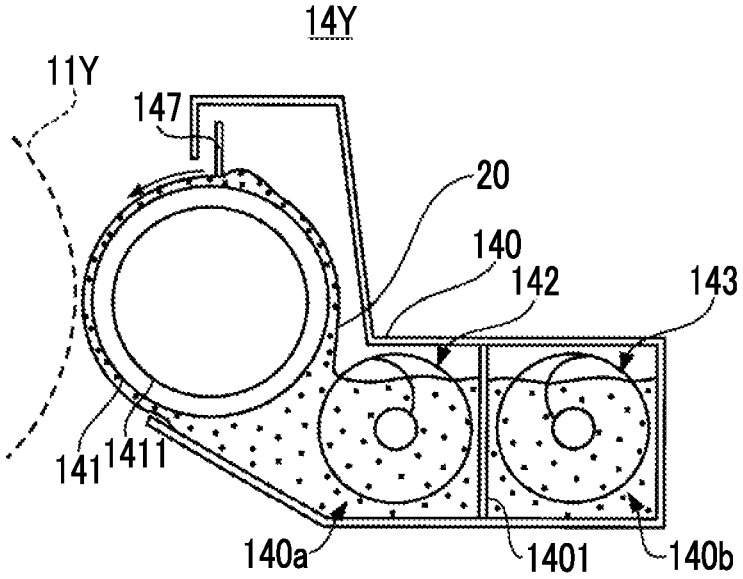
FIG. 2 is a cross-sectional view of a developing device illustrated in FIG. 1.

FIG. 2 is a cross-sectional view of the developing device illustrated in FIG. 1.

The developing device 14Y for the yellow color is illustrated in the drawing. Developing devices 14M to 14K for the other colors have the same structure as the developing device 14Y for the yellow color.

The developing device 14Y includes a developer container 140, a developing roller 141, a first agitating transport member 142, a second agitating transport member 143, and a layer regulating member 147.

A developer 20 that contains the toner and the magnetic carrier is accommodated in the developer container 140. The developer container 140 corresponds to an example of an accommodation tank according to the exemplary embodiment of the invention.

An inner portion of the developer container 140 is partitioned into a first accommodation chamber 140*a* and a second accommodation chamber 140*b* by a partition wall 1401. The first accommodation chamber 140*a* is adjacent to the developing roller 141, and the second accommodation chamber 140*b* is arranged on the side opposite to the developing roller 141 across the first accommodation chamber 140*a*.

The first agitating transport member 142 is provided in the first accommodation chamber 140*a*, and the second agitating transport member 143 is provided in the second accommodation chamber 140*b*. The two agitating transport members 142 and 143 extend in an extension direction (depth direction in the drawing) in which the developing roller 141 extends, and includes rotation axes extending in parallel with the developing roller 141 and spiral-shaped spiral blades disposed in a vicinity of the rotation axes. The developing roller 141 and the two agitating transport members 142 and 143 rotate when a motor (not illustrated) is driven.

The first agitating transport member 142 rotates to transport the developer 20 in the first accommodation chamber 140*a* in the depth direction in the drawing while agitating the developer 20. The second agitating transport member 143 rotates to transport the developer 20 in the second accommodation chamber 140*b* in the transport direction that is opposite to the transport direction in the first accommodation chamber 140*a*. In the depth direction in the drawing, the partition wall 1401 is shorter in length than the developer container 140, and thus communication ports are formed at both ends of the partition wall 1401 to allow the first accommodation chamber 140*a* and the second accommodation chamber 140*b* to communicate with each other. The developer 20 in the developer container 140 circulates in the first accommodation chamber 140*a* and the second accommodation chamber 140*b* through the communication port. The developer 20 acts as a fluid, in which the toner and the magnetic carrier are blended together, through the transport and agitation described above.

The developing roller 141 transports the developer from the developer container 140 to the outer surface of the photoconductor 11Y (refer to FIG. 1). The developing roller 141 corresponds to an example of the transport member according to the exemplary embodiment of the invention. The developing roller 141 has a cylindrical shape, and a magnet 1411 is arranged in the developing roller 141. The magnet 1411 is fixed to the developer container 140, and includes a pickup magnetic pole that adsorbs the magnetic carrier to which the toner particles are adhered to the developing roller 141, and a magnetic pole that allows the developer to form magnetic brush in a developing area. The developing roller 141 rotates, with the developer being held on the outer surface, to transport the developer to the outer surface of the photoconductor 11Y.

The layer regulating member 147 is fixed to the developer container 140, and extends in a direction intersecting the direction in which the developer 20 is transported by the developing roller 141. A gap is present between the layer regulating member 147 and the outer surface of the developing roller 141. When the developer 20 passes through this gap, a layer thickness of the developer 20 that is transported outside the developer container 140 is regulated. The layer regulating member 147 corresponds to an example of the layer regulating member according to the exemplary embodiment of the invention. Instead of a plate-shaped member illustrated herein, a rod-shaped member may also be adopted as the layer regulating member 147.

The toner that is contained in the developer which is transported to the outer surface of the photoconductor 11Y through the gap between the layer regulating member 147 and the developing roller 141 is adhered to a part of the outer surface of the photoconductor 11Y irradiated with the light. The toner and the magnetic carrier that are not adhered to the photoconductor 11Y are held by the developing roller 141 and return to the first accommodation chamber 140*a*. New toner, whose amount corresponds to the amount of the toner consumed in the developing, is supplied to the developer container 140 from the toner cartridge 18Y (refer to FIG. 1).

The gap between the layer regulating member 147 and the developing roller 141 (hereinafter, referred to as a trimmer gap in some cases) is a narrow gap of less than 0.5 mm. The toner in the developer 20 is subjected to refining so that fineness of the image is improved. Accordingly, the developer 20 may aggregate in the trimmer gap. It is considered that the aggregation may be solved in many cases, as the developer 20 is transported, even when the developer 20 aggregates as described above. However, it is also considered that the developer 20 may be clogged in the trimmer gap if the aggregation is not solved. In this exemplary embodiment, a removal mechanism (not illustrated in FIGS. 1 and 2) is disposed in the developing device so as to prevent the clogging by removing the developer 20 on a regular basis from the trimmer gap.

Figure 3B:
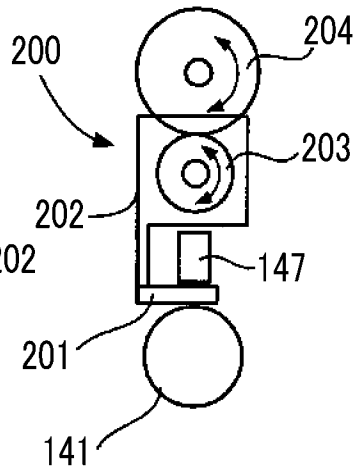
FIG. 3A and FIG. 3B are conceptual configuration diagrams illustrating a removal mechanism that removes a developer.
Figure 3A:
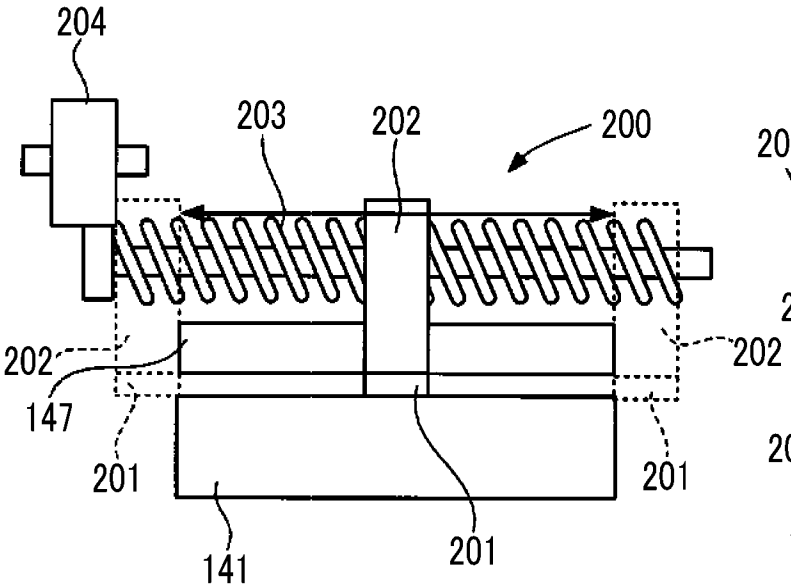

FIG. 3A and FIG. 3B are conceptual configuration diagrams illustrating the removal mechanism that removes the developer.

A conceptual configuration of a removal mechanism 200 is respectively illustrated in FIG. 3A and FIG. 3B. FIG. 3A illustrates FIG. 1 viewed from the left, and FIG. 3B illustrates FIG. 1 viewed from a front surface of FIG. 1.

The removal mechanism 200 includes a removal member 201, a holding member 202, a feed screw 203, and a driving gear 204. The removal member 201 is a member that is inserted into the trimmer gap, which is the gap between the layer regulating member 147 and the developing roller 141, and corresponds to an example of the removal member according to the exemplary embodiment of the invention. When the removal member 201 is moved in the trimmer gap along the layer regulating member 147, the developer is removed from the trimmer gap and the aggregation of the developer is broken. As a result, the clogging in the trimmer gap is prevented. The removal member 201 is a non-magnetic material, representative examples of which include plastic, in this exemplary embodiment. Accordingly, the removal member 201 is not attracted to a magnetic field that is generated by the developing roller 141, and the removal member 201 shows a smooth movement in the trimmer gap.

The holding member 202 holds the removal member 201, is engaged with the feed screw 203, and reciprocates with the removal member 201 in an arrow direction in FIG. 3A as the feed screw 203 rotates. The feed screw 203 is engaged with the driving gear 204, and the driving gear 204 is driven by a motor that is provided in a main body of the image forming apparatus 1. The holding member 202 and the feed screw 203, combined with each other, correspond to an example of a moving mechanism according to the exemplary embodiment of the invention. In this exemplary embodiment, the removal member 201 automatically moves by an example of the moving mechanism.

When the removal member 201 and the holding member 202 are moved to an edge by the feed screw 203, the removal member 201 and the holding member 202 reach a position avoiding the developer which is transported by the developing roller 141. The removal member 201 and the holding member 202 are moved to this position during a normal image formation. In addition, the motor that drives the driving gear 204 is controlled by the control unit 1A illustrated in FIG. 1, and drives the driving gear 204 so that the removal member 201 moves over an entire length of the trimmer gap when a predetermined number of the images are formed. In addition, the developer is more likely to aggregate when a temperature detected by the environment sensor n reaches a predetermined high temperature range than when the temperature is lower than the high temperature range, and thus the removal member 201 is moved, controlled by the control unit 1A, to form a smaller number of the images compared to when the temperature is lower than the high temperature range. In this manner, the aggregation of the developer is efficiently broken and the clogging of the developer is efficiently prevented as the removal member 201 is moved based on a number of forming images or a temperature of the developing device.

Herein, a preferable shape of the removal member 201 will be examined.

Figures 4, 5:
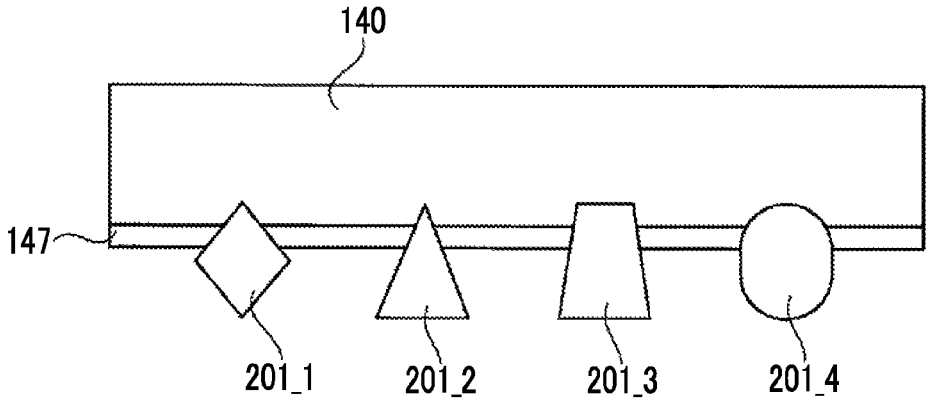
FIG. 4 is a diagram illustrating an example of a shape of a removal member.
FIG. 5 is a table illustrating a relationship between a toner particle diameter and an ease of clogging of the developer in a trimmer gap.

FIG. 4 is a diagram illustrating an example of a shape of the removal member.

FIG. 4 schematically illustrates a positional relationship of the removal member with respect to the developer container 140 and the layer regulating member 147 and illustrates four types of removal members 201_1, 201_2, 201_3, and 201_4. One of the removal members 201_1, 201_2, 201_3, and 201_4 and a removal member having another shape (not illustrated) are used in the actual removal mechanism.

All of the removal members 201_1, 201_2, 201_3, and 201_4 illustrated in FIG. 4 have a tapering width toward an inner portion side (upstream side of the developing roller where the developer is transported) of the developer container 140. In other words, the widths (sizes in the direction in which the layer regulating member 147 extends) of the removal members 201_1, 201_2, 201_3, and 201_4 decrease toward the inner portion side of the developer container 140. When the removal member having this shape is used, the developer that is removed from the trimmer gap returns to the inner portion of the developer container 140 when the removal member is moved along the layer regulating member 147. Accordingly, scattering of the developer outside the developer container 140 is avoided and a vicinity thereof is not dirty. As such, it is preferable that the removal member have the shape illustrated in FIG. 4, that is, the width decreasing toward the inner portion side of the developer container 140.

Next, a toner particle diameter at which the prevention of the clogging by the removal of the developer from the trimmer gap is effective will be examined.

FIG. 5 is a table illustrating a relationship between the toner particle diameter and an ease of the clogging of the developer in the trimmer gap.

The table in FIG. 5 shows the occurrence and non-occurrence of the clogging of the developer at each toner particle diameter with respect to the formation of 10,000 images under each image forming condition in which a use environment and a size of the trimmer gap are changed with each other. The removal mechanism 200 described above is not operated during the image formation of this case.

Circles in the table represent the formation of the 10,000 images without any problem, in which the developer is not clogged at all. A marks represent the occurrence of the clogging of the developer at one place in the trimmer gap. An x mark represents the simultaneous occurrences of the clogging of the developer at plural places in the trimmer gap.

When toner with a volume average particle diameter of 5.5 μm is used in the developer, the clogging of the developer in the trimmer gap does not occur under any image forming conditions. Meanwhile, when toner with a volume average particle diameter of 4.5 μm is used in the developer, the clogging of the developer occurs at one place under an image forming condition where the use environment is 28° C. or higher. Furthermore, when toner with a volume average particle diameter of 3.5 μm is used in the developer, the clogging of the developer occurs under all image forming conditions. In particular, the clogging of the developer occurs simultaneously at the plural places in the trimmer gap under an image forming condition where the use environment is 28° C. or higher and the size of the trimmer gap is less than 0.4 mm. Accordingly, it may be said that the removal of the toner by the removal mechanism described above is particularly effective for the prevention of the clogging of the developer when the volume average particle diameter is 4.5 μm or less. In addition, in view of manufacturability, it is preferable that a lower limit value of the volume average particle diameter of the toner be at least 2.0 μm.

The first exemplary embodiment has been described above. The other exemplary embodiments will be described hereinafter.

A developing device and an image forming apparatus according to a second exemplary embodiment of the invention are the same as those according to the first exemplary embodiment except for the removal mechanism. The following description will focus on the removal mechanism while omitting redundant description.

Figure 6:
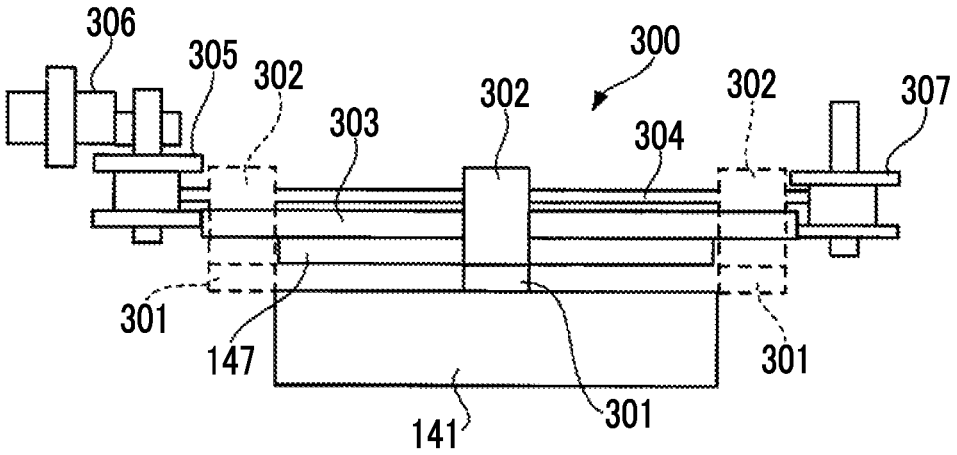
FIG. 6 is a front view illustrating a conceptual configuration of a removal mechanism of a second exemplary embodiment.
Figure 7:
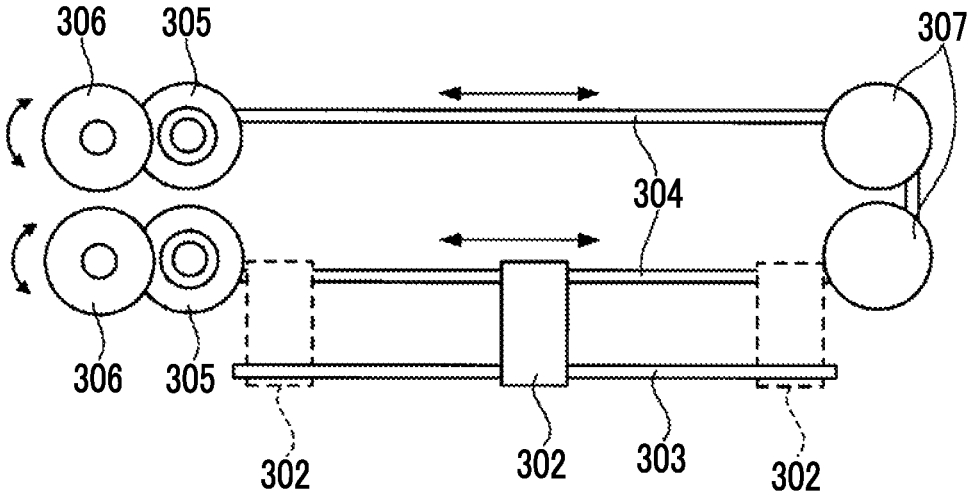
FIG. 7 is a top view illustrating the conceptual configuration of the removal mechanism of the second exemplary embodiment.

FIGS. 6 and 7 are conceptual configuration diagrams illustrating a removal mechanism according to the second exemplary embodiment. FIG. 6 is a front view thereof (that is, a view seen from the left of FIG. 1), and FIG. 7 is a top view thereof (that is, a view seen from above of FIG. 1).

A removal mechanism 300 according to the second exemplary embodiment includes a removal member 301, a holding member 302, a guide rail 303, a moving belt 304, driving pulleys 305, a driving gear 306, and driven pulleys 307. The removal member 301 is a member that is inserted into the trimmer gap, which is the gap between the layer regulating member 147 and the developing roller 141, and corresponds to an example of the removal member according to the exemplary embodiment of the invention. Also in the second exemplary embodiment, the developer is removed from the trimmer gap and the aggregation of the developer is broken when the removal member 301 is moved in the trimmer gap along the layer regulating member 147. As a result, the clogging in the trimmer gap is prevented. The holding member 302 is fixed to the moving belt 304 while holding the removal member 301, and moves with the removal member 301 along the guide rail 303 as the moving belt 304 moves. The two driving pulleys 305 and the two driven pulleys 307 are hung with the moving belt 304, and the moving belt 304 reciprocates in an arrow direction illustrated in FIG. 7 as the driving pulleys 305 and the driven pulleys 307 rotate. The driving gear 306 is driven by the motor provided in the main body of the image forming apparatus 1, and drives the driving pulley 305 that is engaged with the driving gear 306. The holding member 302, the moving belt 304, the driving pulleys 305, and the driven pulleys 307, combined with one another, correspond to an example of the moving mechanism according to the exemplary embodiment of the invention. Also in the second exemplary embodiment, the removal member 301 automatically moves by an example of the moving mechanism.

When the holding member 302 is moved to the edge by the moving belt 304, the removal member 301 reaches the position avoiding the developer which is transported by the developing roller 141. Also in the second exemplary embodiment, the removal member 301 and the holding member 302 are moved to this position during the normal image formation. In addition, also in the second exemplary embodiment, the motor that drives the driving gear 306 is controlled by the control unit 1A as in the first exemplary embodiment. Redundant description as to the similar details of the control will be omitted.

Next, a developing device and an image forming apparatus according to a third exemplary embodiment of the invention will be described. The third exemplary embodiment is the same as the first exemplary embodiment described above except for the removal mechanism. The following description will focus on the removal mechanism while omitting redundant description.

Figure 8:
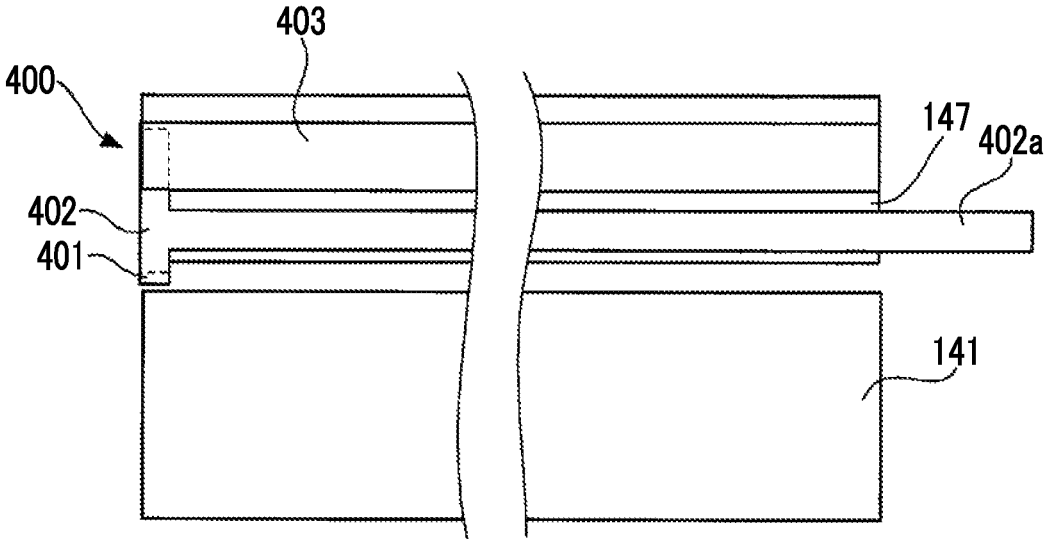
FIG. 8 is a front view illustrating a conceptual configuration of a removal mechanism of a third exemplary embodiment.
Figure 9:
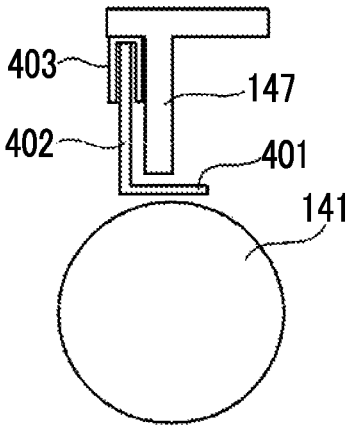
FIG. 9 is a side view illustrating the conceptual configuration of the removal mechanism of the third exemplary embodiment.

FIGS. 8 and 9 are conceptual configuration diagrams illustrating a removal mechanism according to the third exemplary embodiment. FIG. 8 is a front view thereof (that is, a view seen from the left of FIG. 1), and FIG. 9 is a side view thereof (that is, a view seen from the front surface of FIG. 1).

A removal mechanism 400 according to the third exemplary embodiment includes a removal member 401, a holding member 402, and a guide rail 403. The removal member 401 is a member that is inserted into the trimmer gap, which is the gap between the layer regulating member 147 and the developing roller 141, and corresponds to an example of the removal member according to the exemplary embodiment of the invention. Also in the third exemplary embodiment, the developer is removed from the trimmer gap and the aggregation of the developer is broken when the removal member 401 is moved in the trimmer gap along the layer regulating member 147. As a result, the clogging in the trimmer gap is prevented.

The holding member 402 holds the removal member 401, and includes a manipulation arm portion 402*a* that extends to a front side (that is, a front side in FIG. 1 and a right side in FIG. 8) of the image forming apparatus 1. When the manipulation arm portion 402*a* is grabbed by a user and is moved in a left-right direction of FIG. 8, the holding member 402 is moved along the guide rail 403. As a result, the removal member 401 is moved in the trimmer gap along the layer regulating member 147. The holding member 402 corresponds to an example of a moving tool according to the exemplary embodiment of the invention. In the third exemplary embodiment, the user manipulates the holding member 402 to move the removal member 401 at will and break the aggregation of the developer.

The so-called tandem type apparatus including the plural image holding members has been described as an example in each of the exemplary embodiments described above. However, the image forming apparatus according to the exemplary embodiments of the invention may be a so-called revolver type image forming apparatus in which toner images having plural colors are formed on one image holding member.

In addition, the printer has been described as an example of the image forming apparatus in the above description, but the image forming apparatus according to the exemplary embodiments of the invention may be a facsimile, a copier, or a multifunction machine.

In addition, the indirect transfer type image forming apparatus that uses the intermediate image transfer belt has been described as an example of the image forming apparatus in the above description, but the image forming apparatus according to the exemplary embodiments of the invention may be a direct transfer type image forming apparatus in which the toner image is transferred directly to the sheet from the image forming unit.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

an accommodating unit that contains a developer;

a transport member that holds the developer on an outer surface and transports the developer outside from the accommodating unit;

a layer regulating member that faces the outer surface of the transport member with a gap, extends in a direction intersecting a direction in which the developer is transported, and regulates a layer thickness of the developer; and a removal member that is inserted into the gap, moves along the direction in which the layer regulating member extends, and removes the developer from the gap.

2. The developing device according to claim 1, wherein the removal member is shaped to have a width decreasing in the moving direction toward an upstream side in the transport direction of the developer.

3. The developing device according to claim 1, wherein the removal member is a non-magnetic material.

4. The developing device according to claim 1, further comprising:

a moving tool that holds the removal member and moves the removal member with a manipulation force of a user.

5. The developing device according to claim 1, further comprising:

a moving mechanism that holds the removal member and moves the removal member.

6. The developing device according to claim 5, wherein the moving mechanism moves the removal member based on a number of forming images.

7. The developing device according to claim 5, wherein the moving mechanism moves the removal member based on a temperature of the developing device.

8. The developing device according to claim 1, wherein the developer contains toner with a volume average particle diameter of 2.0 μm to 4.5 μm.

9. The developing device according to claim 1, wherein the gap is defined between a surface of the layer regulating member facing the outer surface of the transport member and the outer surface of the transport member.

10. An image forming apparatus comprising:

an image holding member that holds an image on a surface;

a latent image forming device that forms an electrostatic latent image on the outer surface of the image holding member; and a developing device that develops the latent image on the image holding member with a developer, wherein the developing device includes:

an accommodating unit that accommodates the developer;

a transport member that holds the developer on an outer surface and transports the developer outside from the accommodating unit;

a layer regulating member that faces the outer surface of the transport member with a gap, extends in a direction intersecting a direction in which the developer is transported, and regulates a layer thickness of the developer; and a removal member that is inserted into the gap, moves along the direction in which the layer regulating member extends, and removes the developer from the gap.

11. The image forming apparatus according to claim 10, further comprising:

an environment sensor.

12. The image forming apparatus according to claim 11, wherein the removal member moves based on a temperature of the environment sensor.

13. The image forming apparatus according to claim 10, wherein the removal member is shaped to have a width decreasing in the moving direction toward an upstream side in the transport direction of the developer.

14. The image forming apparatus according to claim 10, wherein the removal member is a non-magnetic material.

15. The image forming apparatus according to claim 10, further comprising:

a moving tool that holds the removal member and moves the removal member with a manipulation force of a user.

16. The image forming apparatus according to claim 10, further comprising:

a moving mechanism that holds the removal member and moves the removal member.

* * * * *